US009272400B2

(12) United States Patent
Johnson

(10) Patent No.: US 9,272,400 B2
(45) Date of Patent: Mar. 1, 2016

(54) TORQUE-LIMITED IMPACT TOOL

(71) Applicant: Ingersoll-Rand Company, Davidson, NC (US)

(72) Inventor: Joshua Odell Johnson, Allentown, PA (US)

(73) Assignee: Ingersoll-Rand Company, Davidson, NC (US)

( * ) Notice: Subject to any disclaimer, the term of this patent is extended or adjusted under 35 U.S.C. 154(b) by 560 days.

(21) Appl. No.: 13/711,971

(22) Filed: Dec. 12, 2012

(65) Prior Publication Data

US 2014/0158388 A1 Jun. 12, 2014

(51) Int. Cl.

| | |
|---|---|
| ***B25B 1/02*** | (2006.01) |
| ***B25D 17/06*** | (2006.01) |
| ***B25B 21/02*** | (2006.01) |
| ***B25B 23/147*** | (2006.01) |

(52) U.S. Cl.

CPC ..... *B25B 21/02* (2013.01); *B25B 21/026* (2013.01); *B25B 23/1475* (2013.01); *B25D 17/06* (2013.01)

(58) Field of Classification Search

CPC .... B25B 21/026; B25B 21/02; B25B 21/023; B25B 19/00; B25B 23/1475; B25D 17/06; B25D 11/068; B25D 9/04

USPC ..... 173/1, 93.5

See application file for complete search history.

(56) References Cited

U.S. PATENT DOCUMENTS

| | | | |
|---|---|---|---|
| 2,160,150 | A | 5/1939 | Jimerson et al. |
| 2,160,622 | A | 5/1939 | Olson et al. |
| 2,285,638 | A | 6/1942 | Amtsberg |
| 2,414,066 | A | 1/1947 | Scott |
| 2,533,703 | A | 12/1950 | Wilhide et al. |
| 2,580,631 | A | 1/1952 | Whiteledge |
| 2,802,556 | A | 8/1957 | Schmid |
| 3,001,429 | A | 9/1961 | Sindelar |
| 3,072,232 | A | 1/1963 | Martin et al. |
| 3,321,043 | A | 5/1967 | Vaughn |
| 3,414,066 | A | 12/1968 | Wallace |

(Continued)

FOREIGN PATENT DOCUMENTS

| | | | |
|---|---|---|---|
| CN | 1876330 | A | 12/2006 |
| DE | 29713973 | U1 | 10/1997 |

(Continued)

OTHER PUBLICATIONS

Ingersoll Rand, Torque Limited Air Impact Wrench, 2130XP-TL, Product Information, Sep. 2010, 8 pages.

(Continued)

*Primary Examiner* — Michelle Lopez

(74) *Attorney, Agent, or Firm* — Barnes & Thornburg LLP

(57) ABSTRACT

Illustrative embodiments of torque-limited impact tools are disclosed. An impact tool may include a shaft adapted to rotate about an axis, a hammer having a hammer jaw with an obtuse impact surface, and an anvil having an anvil jaw with an acute impact surface. The shaft may include a first helical groove, and the hammer may include a second helical groove. The impact tool may further include a ball received in the first and second helical grooves, wherein the ball rotationally couples the hammer to the shaft and permits axial travel of the hammer relative to the shaft. The obtuse impact surface of the hammer jaw may be adapted to impact the acute impact surface of the anvil jaw when the shaft rotates in a first direction.

17 Claims, 6 Drawing Sheets

(56) References Cited

U.S. PATENT DOCUMENTS

| | | | |
|---|---|---|---|
| 3,533,479 | A | 10/1970 | Albertson |
| 3,552,499 | A | 1/1971 | Maurer |
| 3,557,884 | A | 1/1971 | Allen |
| 3,561,543 | A | 2/1971 | Ulbing |
| 3,661,217 | A | 5/1972 | Maurer |
| 3,666,023 | A | 5/1972 | Sakamoto |
| 3,703,933 | A | 11/1972 | Schoeps |
| 4,016,938 | A | 4/1977 | Rice |
| 4,023,627 | A | 5/1977 | Clapp et al. |
| 4,026,369 | A | 5/1977 | Vliet |
| 4,084,646 | A | 4/1978 | Kurt et al. |
| 4,142,447 | A | 3/1979 | Krasnoff et al. |
| 4,243,109 | A | 1/1981 | Anderson |
| 4,243,111 | A | 1/1981 | Willoughby et al. |
| 4,287,956 | A | 9/1981 | Maurer |
| 4,321,973 | A | 3/1982 | Maurer |
| 4,397,220 | A | 8/1983 | Russo et al. |
| 4,440,237 | A | 4/1984 | Casperovich |
| 4,487,272 | A | 12/1984 | Bleicher et al. |
| 4,919,022 | A | 4/1990 | Ono et al. |
| 4,977,966 | A | 12/1990 | Farber et al. |
| 5,022,309 | A | 6/1991 | Campbell |
| 5,031,505 | A | 7/1991 | Campbell |
| RE33,711 | E | 10/1991 | Ono et al. |
| 5,123,504 | A | 6/1992 | Oetting et al. |
| 5,167,309 | A | 12/1992 | Albert et al. |
| 5,172,774 | A | 12/1992 | Melrose |
| 5,197,711 | A | 3/1993 | Geiger et al. |
| 5,213,167 | A | 5/1993 | Best et al. |
| 5,284,318 | A | 2/1994 | Geiger et al. |
| 5,293,747 | A | 3/1994 | Geiger |
| 5,293,959 | A | 3/1994 | Kimberlin |
| 5,305,835 | A | 4/1994 | Campbell |
| 5,346,024 | A | 9/1994 | Geiger et al. |
| 5,350,025 | A | 9/1994 | Campbell et al. |
| 5,377,769 | A | 1/1995 | Hasuo et al. |
| 5,400,860 | A | 3/1995 | Best et al. |
| 5,573,073 | A | 11/1996 | Schofield et al. |
| 5,592,396 | A | 1/1997 | Tambini et al. |
| 5,595,251 | A | 1/1997 | Cook |
| 5,636,698 | A | 6/1997 | Estep et al. |
| 5,680,808 | A | 10/1997 | Day et al. |
| 5,689,434 | A | 11/1997 | Tambini et al. |
| 5,738,177 | A | 4/1998 | Schell et al. |
| 5,845,718 | A | 12/1998 | Cooper et al. |
| 5,848,655 | A | 12/1998 | Cooper et al. |
| 5,906,244 | A | 5/1999 | Thompson et al. |
| 6,024,180 | A | 2/2000 | Lin |
| 6,070,674 | A | 6/2000 | Williamson et al. |
| 6,093,128 | A | 7/2000 | Seith |
| 6,135,212 | A | 10/2000 | Georgiou |
| 6,165,096 | A | 12/2000 | Seith |
| 6,491,111 | B1 | 12/2002 | Livingston et al. |
| 6,581,697 | B1 | 6/2003 | Giardino |
| 6,889,778 | B2 | 5/2005 | Colangelo, III |
| 7,510,023 | B1 | 3/2009 | Cheng |
| 7,673,702 | B2 | 3/2010 | Johnson et al. |
| 8,042,621 | B2 | 10/2011 | Barezzani et al. |
| 2003/0009262 | A1 | 1/2003 | Colangelo et al. |
| 2009/0038816 | A1* | 2/2009 | Johnson ..... B25B 21/026 173/109 |
| 2009/0056966 | A1 | 3/2009 | Grand et al. |
| 2010/0025063 | A1 | 2/2010 | Kuhnapfel et al. |

FOREIGN PATENT DOCUMENTS

| | | | |
|---|---|---|---|
| DE | 20118029 | U1 | 1/2002 |
| EP | 2263833 | B1 | 12/2010 |
| GB | 763116 | | 12/1956 |
| GB | 2055653 | A | 3/1981 |
| GB | 2059317 | A | 4/1981 |
| GB | 2380962 | A | 4/2003 |
| JP | 2000052268 | A | 2/2000 |
| JP | 2002046079 | A | 2/2002 |
| JP | 2003071736 | A | 3/2003 |
| TW | 200817141 | A | 4/2008 |
| WO | 9917909 | | 4/1999 |

OTHER PUBLICATIONS

Chinese Office Action and English Translation for Chinese Patent Application No. 201310681033.2, dated May 7, 2015.

* cited by examiner

TORQUE-LIMITED IMPACT TOOL

TECHNICAL FIELD

The present invention relates generally to impact tools. More particularly, the present invention relates to torque-limited impact tool.

BACKGROUND

An impact wrench is one illustrative embodiment of an impact tool, which may be used to install and remove threaded fasteners. An impact wrench generally includes a motor coupled to an impact mechanism that converts the torque of the motor into a series of powerful rotary blows directed from a hammer to an output shaft called an anvil.

SUMMARY

According to one aspect of the present disclosure, an impact tool may comprise a shaft adapted to rotate about an axis, the shaft having a first helical groove, a hammer having a second helical groove and a hammer jaw with an obtuse impact surface, a ball received in the first and second helical grooves, wherein the ball rotationally couples the hammer to the shaft and permits axial travel of the hammer relative to the shaft, and an anvil having an anvil jaw with an acute impact surface, wherein the obtuse impact surface of the hammer jaw is adapted to impact the acute impact surface of the anvil jaw when the shaft rotates in a first direction.

In some embodiments, the hammer jaw may include a forward impact face having a hammer lug extending outwardly from the forward impact face, the obtuse impact surface forming an edge of the hammer lug. The obtuse impact surface may be disposed at an obtuse angle with respect to the forward impact face. The obtuse angle may be greater than 90 degrees and less than 180 degrees. The obtuse angle may be greater than 105 degrees and less than 165 degrees.

In some embodiments, the anvil jaw may include a central section and an anvil lug extending outwardly from the central section, the acute impact surface forming an edge of the anvil lug. The central section and the anvil lug may form a rearward impact face of the anvil jaw, and the acute impact surface may be disposed at an acute angle with respect to the rearward impact face. The acute angle may be greater than 0 degrees and less than 90 degrees. The acute angle may be greater than 15 degrees and less than 75 degrees.

In some embodiments, the hammer lug may include a first vertical impact surface and the anvil lug may include a second vertical impact surface, the first vertical impact surface being adapted to impact the second vertical impact when the shaft rotates in a second direction. A sum of the obtuse and acute angles may be about 180 degrees.

According to another aspect of the present disclosure, an impact tool may include a hammer configured to selectively rotate in a first direction and in a second direction opposite the first direction, the hammer including a hammer jaw with a forward impact face, an anvil including an output shaft and an anvil jaw with a rearward impact face, a spring biasing the hammer toward a first position in which the forward impact face of the hammer jaw is in contact with the rearward impact face of the anvil jaw, and a cam configured to push the hammer at predetermined rotational intervals to a second position in which the forward impact face of the hammer jaw is out of contact with the rearward impact face of the anvil jaw. The hammer jaw may include a hammer lug having an obtuse impact surface disposed at an obtuse angle with respect to the forward impact face of the hammer jaw, and the anvil jaw may include an anvil lug having an acute impact surface disposed at an acute angle with respect to the rearward impact face of the anvil jaw.

In some embodiments, the obtuse angle may be greater than 105 degrees and less than 165 degrees. The acute angle may be greater than 15 degrees and less than 75 degrees. A sum of the obtuse and acute angles may be about 180 degrees.

In some embodiments, the obtuse impact surface of the hammer lug may be adapted to impact the acute impact surface of the anvil lug when the hammer rotates in the first direction. The hammer lug may further include a first vertical impact surface and the anvil lug may further include a second vertical impact surface, the first vertical impact surface being adapted to impact the second vertical impact when the hammer rotates in the second direction.

According to yet another aspect of the present disclosure, a method of operating an impact tool may include rotating a shaft of the impact tool about an axis in a first direction and pushing a hammer coupled to the shaft against an anvil at predetermined rotational intervals such that a first impact surface of the hammer contacts a second impact surface of the anvil, the first impact surface being disposed at an angle of greater than 90 degrees and less than 180 degrees with respect to the axis and the second impact surface being disposed at an angle greater than 0 degrees and less than 90 degrees with respect to the axis.

In some embodiments, the method may further include rotating the shaft about the axis in a second direction opposite the first direction and pushing the hammer against the anvil at predetermined rotational intervals such that a third impact surface of the hammer contacts a fourth impact surface of the anvil, the third and fourth impact surfaces being disposed parallel to the axis.

In some embodiments, angle at which the first impact surface is disposed with respect to the axis may be greater than 105 degrees and less than 165 degrees. The angle at which the second impact surface is disposed with respect to the axis may be greater than 15 degrees and less than 75 degrees. A sum of the angle at which the first impact surface is disposed with respect to the axis and the angle at which the second impact surface is disposed with respect to the axis may be about 180 degrees.

BRIEF DESCRIPTION

The concepts described in the present disclosure are illustrated by way of example and not by way of limitation in the accompanying figures. For simplicity and clarity of illustration, elements illustrated in the figures are not necessarily drawn to scale. For example, the dimensions of some elements may be exaggerated relative to other elements for clarity. Further, where considered appropriate, reference labels have been repeated among the figures to indicate corresponding or analogous elements.

DETAILED DESCRIPTION

Figure 1:
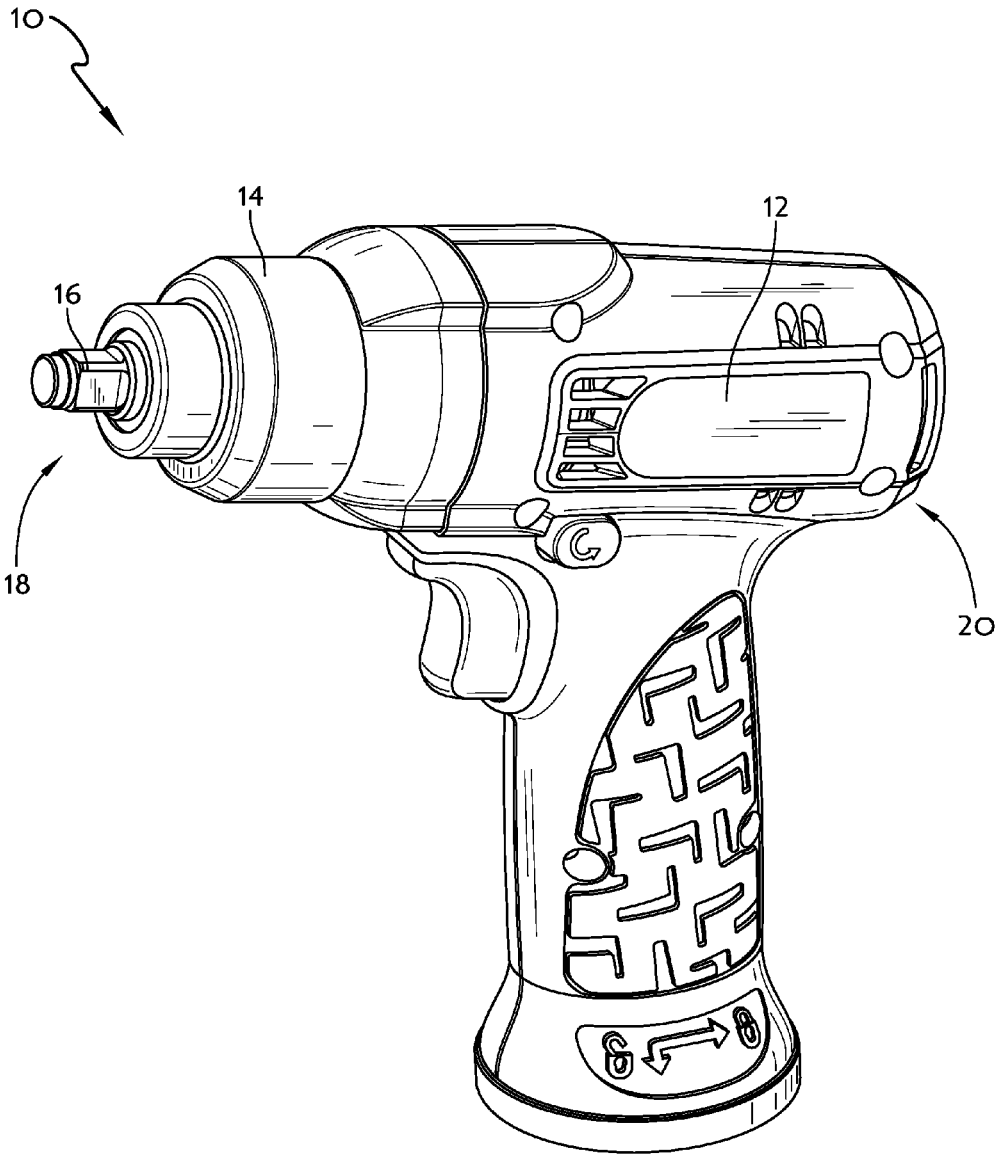
FIG. 1 is a perspective view of at least one embodiment of an impact tool.

While the concepts of the present disclosure are susceptible to various modifications and alternative forms, specific exemplary embodiments thereof have been shown by way of example in the figures and will herein be described in detail. It should be understood, however, that there is no intent to limit the concepts of the present disclosure to the particular forms disclosed, but on the contrary, the intention is to cover all modifications, equivalents, and alternatives falling within the spirit and scope of the present disclosure.

One illustrative embodiment of an torque-limited impact tool 10 is depicted in FIGS. 1-7. The impact tool 10 includes a motor 12, an impact mechanism 14 driven by the motor 12, and an output shaft 16 driven for rotation by the impact mechanism 14. The motor 12 may illustratively be embodied as an electric or pneumatic motor. The impact tool 10 has a forward output end 18 and a rear end 20.

The impact mechanism 14 of the impact tool 10 is of the type commonly known as a ball-and-cam impact mechanism. U.S. Pat. No. 2,160,150 to Emerson et al., the entire disclosure of which is hereby incorporated by reference, describes at least one embodiment of such a ball-and-cam impact mechanism. Other illustrative embodiments of ball-and-cam impact mechanisms are described in U.S. Pat. No. 7,673,702 to Johnson et al., the entire disclosure of which is hereby incorporated by reference.

Figure 2:
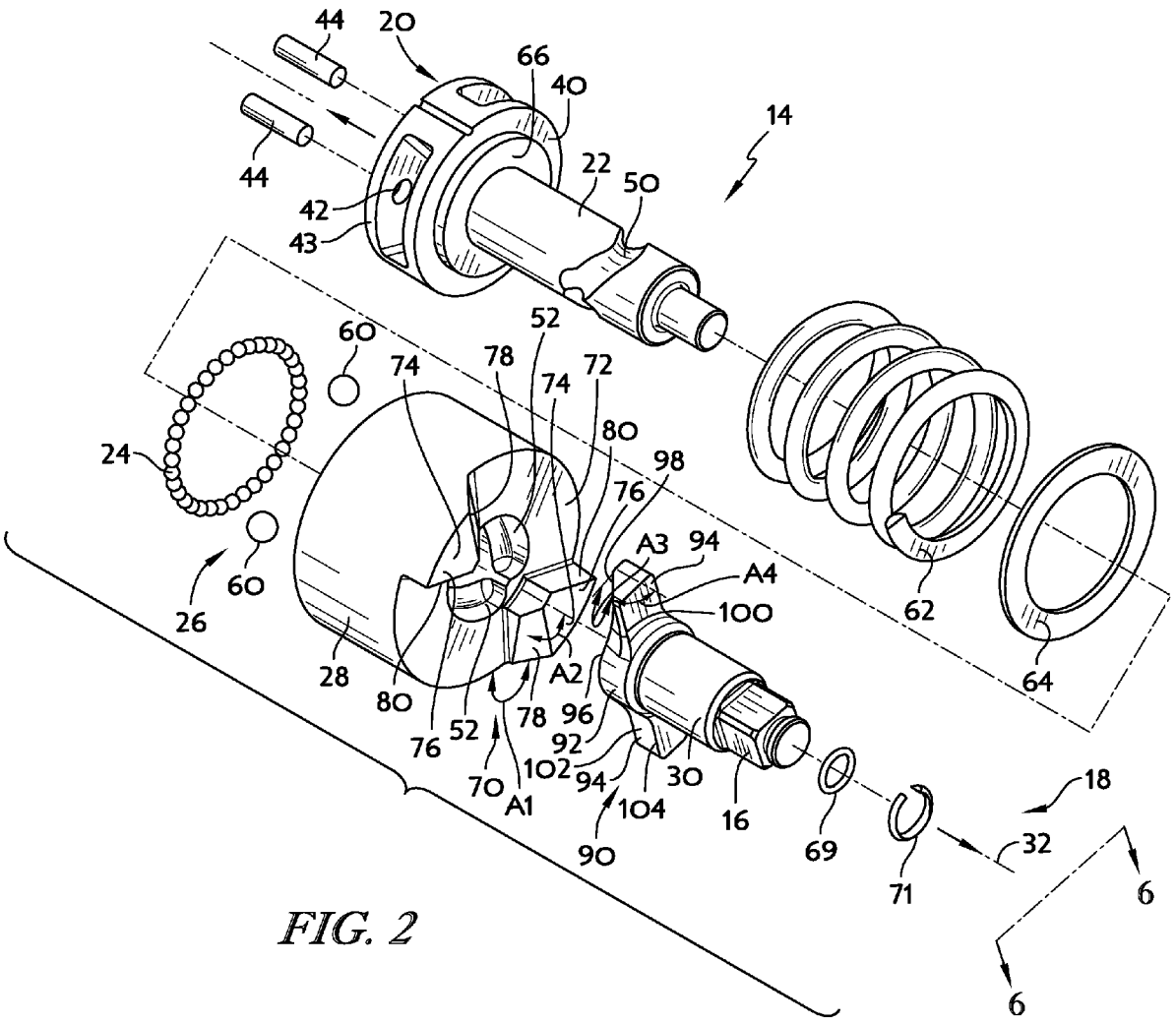
FIG. 2 is an exploded perspective view of an impact mechanism of the impact tool of FIG. 1 from a first, impact side of the impact mechanism.
Figure 3:
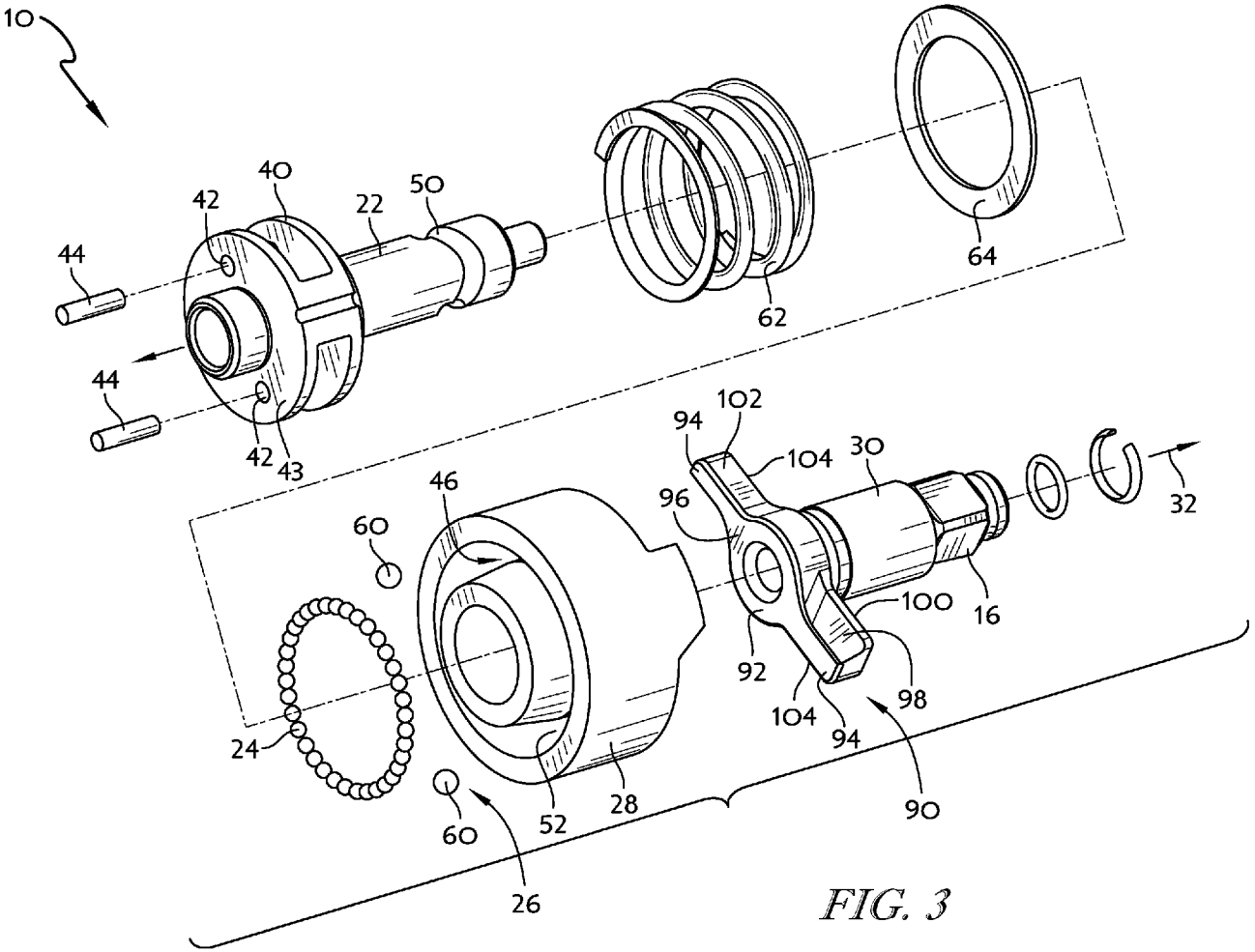
FIG. 3 is an exploded perspective view of the impact mechanism of FIG. 2 from a second, opposite side of the impact mechanism.

Referring now to FIGS. 2 and 3, one illustrative embodiment of the impact mechanism 14 includes a cam shaft 22, a bearing 24, an impact bearing 26, a hammer 28, and an anvil 30. The cam shaft 22 is driven for rotation about a longitudinal axis 32 by the motor 12. The cam shaft 22 includes a planetary gear carrier 40 for coupling to the motor 12. Gear pin holes 42 extend through a base 43 of the planetary gear carrier 40 and receive pins 44 for coupling to the motor 12. The cam shaft 22 is coupled to the hammer 28 through the impact bearing 26, and the hammer 28 includes an annular recess 46 for receiving the bearing 24. The hammer 28 is rotatable over the bearing 24 and, in turn, drives rotation of the anvil 30 about the longitudinal axis 32. In some embodiments, the anvil 30 may be integrally formed with the output shaft 16. In other embodiments, the anvil 30 and the output shaft 16 may be formed separately and coupled to one another.

Figure 6:
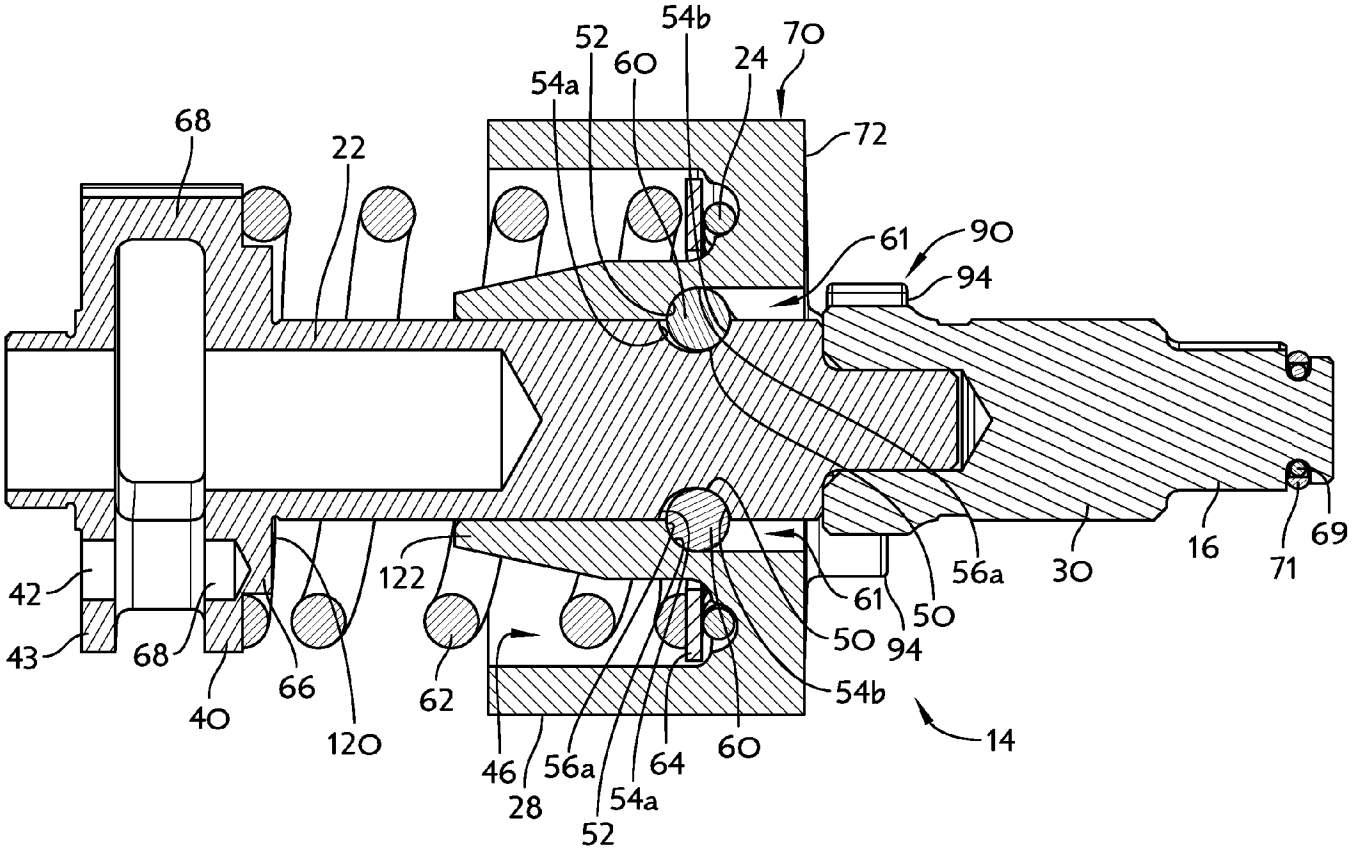
FIG. 6 is a cross-sectional view of the assembled impact mechanism of FIG. 2 taken generally along the line 6-6 of FIG. 2.
Figure 7:
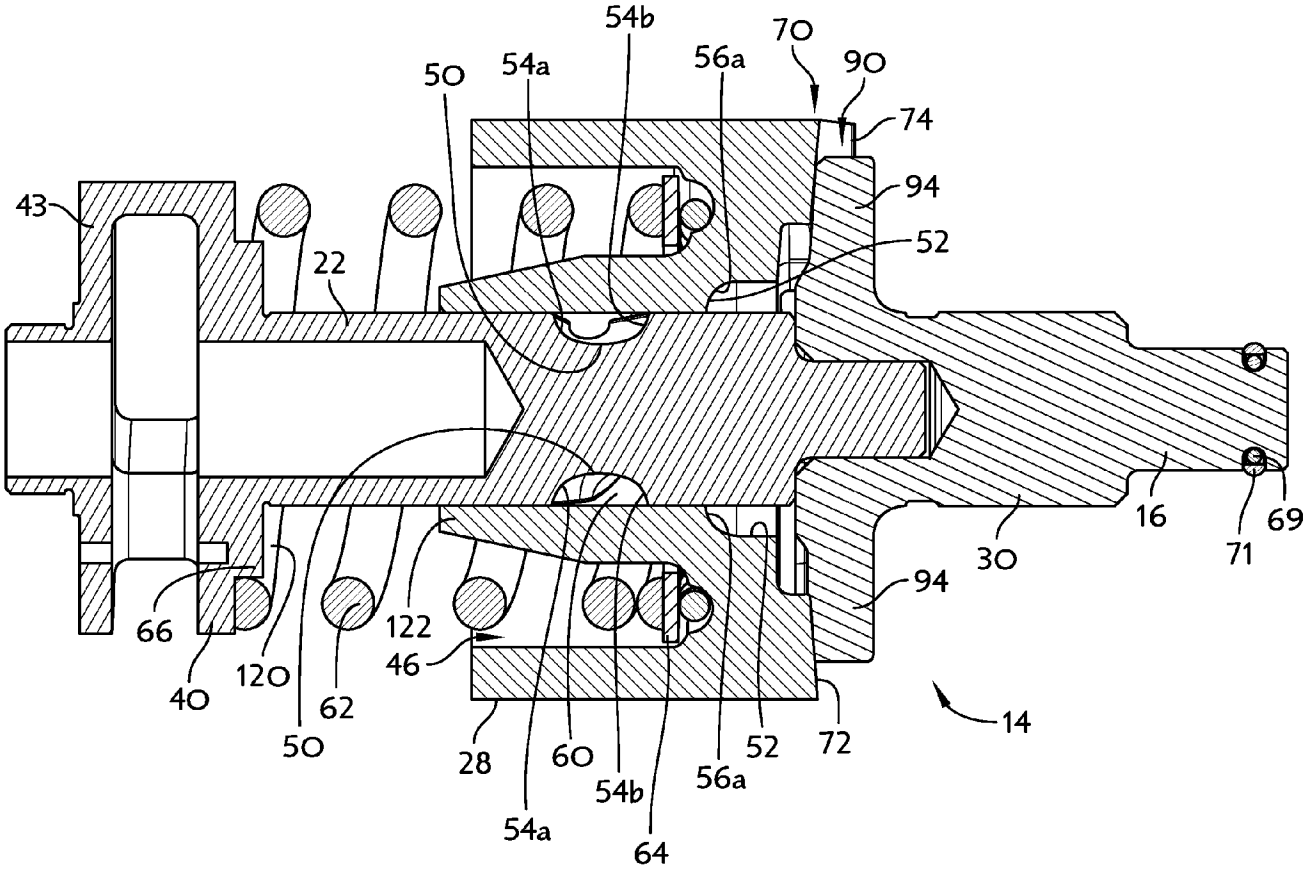
FIG. 7 is a cross-sectional view of the assembled impact mechanism of FIG. 2 taken generally along the line 6-6 of FIG. 2, with the hammer rotated.

The cam shaft 22 includes a pair of helical grooves 50, and the hammer 28 includes two helical grooves 52. The hammer grooves 52 have open ends facing the anvil 30 for ease of machining and assembly. Thus, as best seen in FIGS. 6 and 7, the cam shaft grooves 50 are partially defined by a forward facing wall 54*a* and a rearward facing wall 54*b*, while the hammer grooves 52 are partially defined by a forward facing wall 56*a* but lack a rearward facing wall. Two ball bearings 60 forming the impact bearing 26 couple the cam shaft 22 to the hammer 28. Each ball bearing 60 is received in a race 61 formed by the hammer groove 52 and the corresponding cam shaft groove 50.

A spring 62 and a washer 64 are disposed between the planetary gear carrier 40 and the hammer 28 to bias the hammer 28 away from the planetary gear carrier 40. The washer 64 and an end portion of the spring 62 are received within the annular recess 46 in the hammer 28 and abut the bearing 24.

A cylindrical flange 66 extends forward from the planetary gear carrier 40 for aligning the spring 62 between the planetary gear carrier 40 and the hammer 28. The cylindrical flange 66 may include blind holes 68 for receiving the pins 44 extending through the planetary gear carrier 40. While the cylindrical flange 66 is shown as being integral with the planetary gear carrier 40, the cylindrical flange 66 may be a separate piece sandwiched between the planetary gear carrier 40 and the spring 62.

A flexible O-ring 69 and a retaining ring 71 are disposed over an end of the output shaft 16 to aid in holding the output shaft 16 within a socket of a tool to be attached to the output shaft 16. While the output shaft 16 is shown as being a square drive output shaft, the principles of the present disclosure may be used with any suitable output shaft.

Figure 4:
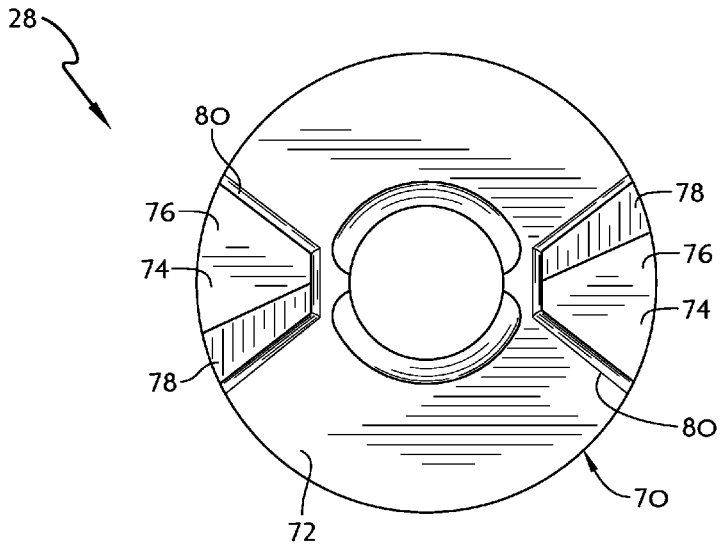
FIG. 4 is a top elevational view of a hammer of the impact mechanism of FIGS. 2 and 3.

Referring to FIGS. 2 and 4, the hammer 28 includes a hammer jaw 70 having a forward impact face 72. The forward impact face 72 includes a pair of lugs 74 extending outwardly from the impact face 72 for driving rotation of the anvil 30, as will be discussed below. Each of the lugs 74, which may be integrally formed with the hammer 28, includes a forward impact surface 76 that is generally parallel to the impact face 72, an obtuse impact surface 78, and a generally vertical impact surface 80, which is generally parallel to the longitudinal axis 32. While the illustrative embodiment includes two lugs 74, any suitable number of lugs 74 may be utilized.

The obtuse impact surface 78 is disposed at an obtuse angle A1 with respect to the impact face 72. In some illustrative embodiments, the angle A1 is greater than 90 degrees and less than 180 degrees. In further illustrative embodiments, the angle A1 is between about 105 degrees and about 165 degrees. In still further illustrative embodiments, the angle A1 is between about 120 degrees and about 150 degrees. The obtuse impact surface 78 is also disposed at an obtuse angle A2 with respect to the longitudinal axis 32 (or an axis parallel to the longitudinal axis 32). In some illustrative embodiments, the angle A2 is greater than 90 degrees and less than 180 degrees. In further illustrative embodiments, the angle A2 is between about 105 degrees and about 165 degrees. In still further illustrative embodiments, the angle A2 is between about 120 degrees and about 150 degrees.

Figure 5A:
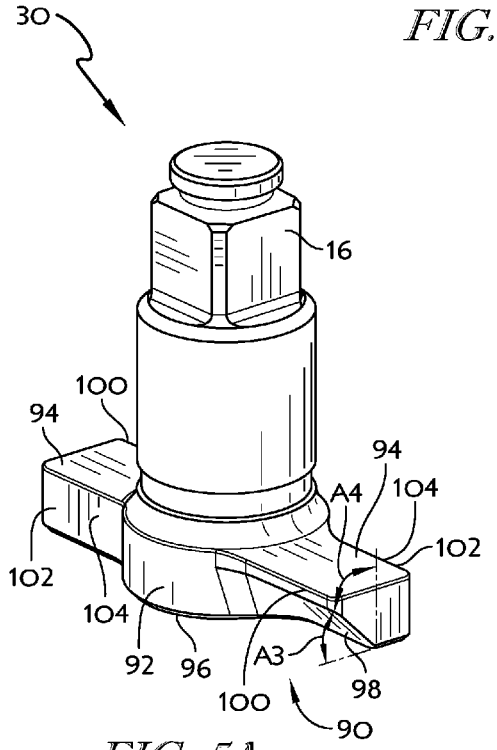
FIG. 5A is a top perspective view of an anvil of the impact mechanism of FIGS. 2 and 3.
Figure 5B:
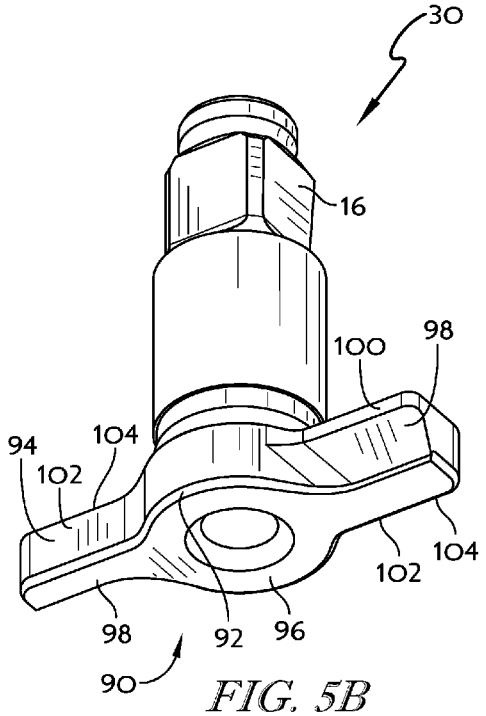
FIG. 5B is a bottom perspective view of the anvil of FIG. 5A.

As best seen in FIGS. 3, 5A, and 5B, the anvil 30, which may be integrally formed with the output shaft 16, includes an anvil jaw 90 with a central section 92 and two outwardly extending lugs 94. The central section 92 and the lugs 94 form a rearward impact face 96. Each of the lugs 94 includes an acute impact surface 98 formed in a leading edge 100 of each lug 94 and a generally vertical impact surface 102 formed in a trailing edge 104 of each lug 94, wherein the generally vertical impact surface 102 is substantially parallel to the longitudinal axis 32. The lugs 94 may be integrally formed with the anvil 30. While the illustrative embodiment includes two lugs 94, any suitable number of lugs 94 may be utilized.

The acute impact surface 98 is disposed at an angle A3 with respect to the rearward impact face 96. In some illustrative embodiments, the angle A3 is greater than 0 degrees less than 90 degrees. In further illustrative embodiments, the angle A3 is between about 15 degrees and about 75 degrees. In still further illustrative embodiments, the angle A3 is between about 30 degrees and about 60 degrees. The acute impact surface 98 is also disposed at an acute angle A4 with respect to the longitudinal axis 32 (or an axis parallel to the longitudinal axis 32). In some illustrative embodiments, the angle A4 is greater than 0 degrees less than 90 degrees. In further illustrative embodiments, the angle A4 is between about 15 degrees and about 75 degrees. In still further illustrative embodiments, the angle A4 is between about 30 degrees and about 60 degrees.

To assemble the impact mechanism 14, the spring 62 and the washer 64 are inserted over the cam shaft 22. The bearing 24 is placed within the annular recess 46 and the hammer 28 is inserted over the cam shaft 22 to receive the washer 64 and an end portion of the spring 62 within the annular recess 46. Next, the hammer 28 is moved toward the cylindrical flange 66 against the force of the spring 62. As the hammer 28 moves axially towards the cylindrical flange 66, there is a clearance between the cam shaft 22 and the hammer 28 at the hammer grooves 52, so that the cam shaft grooves 50 are exposed. This clearance is provided by the open end of the hammer grooves 52, and is slightly greater than a diameter of the ball bearings 60. One ball bearing 60 is inserted into each of the grooves 52 of the hammer 28 and a corresponding cam shaft groove 50, and the hammer 28 is released. The biasing force of the spring 62 forces the hammer 28 away from the cylindrical flange 66. The forward-facing wall 52*a* of the hammer groove 52 presses against a rearward portion of the ball bearings 60. This presses a forward portion of the ball bearings 60 against the rearward-facing surface 50*b* of the cam shaft groove 50. The ball bearings 60 are thereby trapped between the cam shaft 22 and the hammer 28, and couple the hammer 28 to the cam shaft 22. The cam shaft grooves 50 need not be aligned with the hammer grooves 52 to permit installation. Rather, as the hammer 28 moves away from the cam shaft 22 when released, the hammer 28 rotates slightly over the ball bearings 60 to align the hammer grooves 52 with the cam shaft grooves 50 in a neutral position.

The impact mechanism 14 may further include an axial stop for limiting axial displacement of the hammer 28 towards the rear end 20. The axial stop may include a first stop member 120 formed by the cylindrical flange 66 (or on another, separate piece disposed adjacent the planetary gear carrier 40) facing the hammer 28 and a pair of opposing second stop members 122 on the hammer 28 facing the cylindrical flange 66. In the illustrative embodiment, the stop members 120, 122 are a flange and bosses, respectively. In other embodiments (not shown), the stop members 120, 122 may have different shapes.

In operation, the motor 12 drives rotation of the cam shaft 22 about the longitudinal axis 32. During nut rundown, (i.e., when rotation of the anvil 30 is not significantly opposed), the hammer 28 rotates with the cam shaft 22 over the bearing 24. Rotational torque is transferred from the cam shaft 22 to the hammer 28 through the impact bearing 26. The hammer lugs 74 cooperate with the anvil lugs 94 to drive rotation of the anvil 30 and thereby the output shaft 16.

The motor 12 and the impact mechanism 14, which includes the hammer 28 and the anvil 30, are adapted to rotate the output shaft 16 in both clockwise and counterclockwise directions, for tightening or loosening various fasteners. FIGS. 6 and 7 show the impact mechanism 14 as the nut, or other fastener, tightens (fastener not shown). During operation, a cam formed by the grooves 50 in the cam shaft 22 drives the hammer 28 through the ball bearings 60 trapped in the races 61. The spring 62 forces the hammer forward away from the cam. During the rundown phase, the hammer jaw 70 and the anvil jaw 90 remain in full engagement. When the fastener tightens, the cam pulls the hammer 28 to the rear, causing the hammer 28 to back up the helical cam groove 50 and lift itself over the anvil jaw 90, so that it can rotate another half revolution for another impact. When the hammer 28 rotates far enough to clear the anvil jaw 90, the spring 62 thrusts the hammer 28 forward in time for full engagement with the anvil jaw 90 at the instant of impact. This process may repeat itself with great rapidity, as the motor 12 continues operation.

The obtuse impact surfaces 78 of the lugs 74 of the hammer jaw 70 are configured to impact the acute impact surfaces 98 of the lugs 94 of the anvil jaw 90. In one illustrative embodiment, the angles A1 and A3 formed by the obtuse and acute impact surfaces 78, 98, respectively, with respect to the forward impact and rearward impact faces 72, 96 total about 180 degrees. Similarly, the angles A2 and A4 formed by the obtuse and acute impact surfaces 78, 98, respectively, with respect to the longitudinal axis 32 may total about 180 degrees. In other embodiments, the angles A1 and A3 and/or the angles A2 and A4 may total other than 180 degrees. The obtuse impact surfaces 78 of the hammer 28 and the acute impact surfaces 98 of the anvil 30 provide a torque-limiting feature for the impact tool 10. In particular, in a first direction (for example the clockwise direction), the impact of the obtuse impact surfaces 78 of the lugs 74 of the hammer 28 upon the acute impact surfaces 98 of the lugs 94 of the anvil jaw 90 limit the amount of energy that can be transferred from the hammer 28 into the anvil 30, thus reducing output torque of the impact tool 10. This limits torque, for example, during tightening or fastening, thus preventing over-tightening of fasteners.

In a second direction opposite the first direction (for example the counterclockwise direction), the generally vertical impact surfaces 80 of the lugs 74 of the hammer jaw 70 impact the generally vertical impact surfaces 102 of the lugs 94 of the anvil jaw 90. The generally vertical orientation of the vertical impact surfaces 80, 102, would allow for high torque output, for example, during removal of fasteners.

Each of the lugs 74, 94 of the hammer and the anvil jaws 70, 90, respectively, as described in detail above, are asymmetrical in the illustrative embodiment. In this manner, the hammer and anvil jaws 70, 90 provide different torque outputs in the clockwise and counterclockwise directions. In other illustrative embodiments, the obtuse and acute impact surfaces 78, 98 may be switched with the generally vertical impact surfaces 80, 102, respectively, for some applications.

While certain illustrative embodiments have been described in detail in the figures and the foregoing description, such an illustration and description is to be considered as exemplary and not restrictive in character, it being understood that only illustrative embodiments have been shown and described and that all changes and modifications that come within the spirit of the disclosure are desired to be protected. There are a plurality of advantages of the present disclosure arising from the various features of the apparatus, systems, and methods described herein. It will be noted that alternative embodiments of the apparatus, systems, and methods of the present disclosure may not include all of the features described yet still benefit from at least some of the advantages of such features. Those of ordinary skill in the art may readily devise their own implementations of the apparatus, systems, and methods that incorporate one or more of the features of the present disclosure.

The invention claimed is:

1. An impact tool comprising:

a shaft adapted to rotate about an axis, the shaft having a first helical groove;

a hammer having a second helical groove and a hammer jaw with an obtuse impact surface;

a ball received in the first and second helical grooves, wherein the ball rotationally couples the hammer to the shaft and permits axial travel of the hammer relative to the shaft; and an anvil having an anvil jaw with an acute impact surface, wherein the obtuse impact surface of the hammer jaw is adapted to impact the acute impact surface of the anvil jaw when the shaft rotates in a first direction, wherein the hammer jaw includes a forward impact face having a hammer lug extending outwardly from the forward impact face, the obtuse impact surface forming an edge of the hammer lug and disposed at an obtuse angle with respect to the forward impact face.

2. The impact tool of claim 1, wherein the obtuse angle is greater than 105 degrees and less than 165 degrees.

3. The impact tool of claim 1, wherein the anvil jaw includes a central section and an anvil lug extending outwardly from the central section, the acute impact surface forming an edge of the anvil lug.

4. The impact tool of claim 3, wherein the central section and the anvil lug form a rearward impact face of the anvil jaw and the acute impact surface is disposed at an acute angle with respect to the rearward impact face.

5. The impact tool of claim 4, wherein the acute angle is greater than 15 degrees and less than 75 degrees.

6. The impact tool of claim 4, wherein the hammer lug includes a first vertical impact surface and the anvil lug includes a second vertical impact surface, the first vertical impact surface being adapted to impact the second vertical impact surface when the shaft rotates in a second direction.

7. The impact tool of claim 4, wherein a sum of the obtuse and acute angles is about 180 degrees.

8. An impact tool comprising:

a hammer configured to selectively rotate in a first direction and in a second direction opposite the first direction, the hammer including a hammer jaw with a forward impact face;

an anvil including an output shaft and an anvil jaw with a rearward impact face;

a spring biasing the hammer toward a first position in which the forward impact face of the hammer jaw is in contact with the rearward impact face of the anvil jaw; and a cam configured to push the hammer at predetermined rotational intervals to a second position in which the forward impact face of the hammer jaw is out of contact with the rearward impact face of the anvil jaw;

wherein the hammer jaw includes a hammer lug having an obtuse impact surface disposed at an obtuse angle with respect to the forward impact face of the hammer jaw and the anvil jaw includes an anvil lug having an acute impact surface disposed at an acute angle with respect to the rearward impact face of the anvil jaw.

9. The impact tool of claim 8, wherein the obtuse angle is greater than 105 degrees and less than 165 degrees.

10. The impact tool of claim 9, wherein the acute angle is greater than 15 degrees and less than 75 degrees.

11. The impact tool of claim 10, wherein a sum of the obtuse and acute angles is about 180 degrees.

12. The impact tool of claim 8, wherein the obtuse impact surface of the hammer lug is adapted to impact the acute impact surface of the anvil lug when the hammer rotates in the first direction.

13. The impact tool of claim 12, wherein the hammer lug further comprises a first vertical impact surface and the anvil lug further comprises a second vertical impact surface, the first vertical impact surface being adapted to impact the second vertical impact surface when the hammer rotates in the second direction.

14. A method of operating an impact tool comprising:

rotating a shaft of the impact tool about an axis in a first direction; and pushing a hammer against an anvil at predetermined rotational intervals such that a first impact surface of the hammer contacts a second impact surface of the anvil, the hammer being coupled to the shaft through a ball-and-cam defined by a ball and a helical groove defined in each of the shaft and the hammer, the first impact surface being disposed at an angle of greater than 90 degrees and less than 180 degrees with respect to the axis, and the second impact surface being disposed at an angle greater than 0 degrees and less than 90 degrees with respect to the axis, wherein a sum of the angle at which the first impact surface is disposed with respect to the axis and the angle at which the second impact surface is disposed with respect to the axis is about 180 degrees.

15. A method of operating an impact tool comprising:

rotating a shaft of the impact tool about an axis in a first direction;

pushing a hammer against an anvil at predetermined rotational intervals such that a first impact surface of the hammer contacts a second impact surface of the anvil, the hammer being coupled to the shaft through a ball-and-cam defined by a ball and a helical groove defined in each of the shaft and the hammer, the first impact surface being disposed at an angle of greater than 90 degrees and less than 180 degrees with respect to the axis, and the second impact surface being disposed at an angle greater than 0 degrees and less than 90 degrees with respect to the axis;

rotating the shaft about the axis in a second direction opposite the first direction; and pushing the hammer against the anvil at predetermined rotational intervals such that a third impact surface of the hammer contacts a fourth impact surface of the anvil, the third and fourth impact surfaces being disposed parallel to the axis.

16. The method of claim 15, wherein the angle at which the first impact surface is disposed with respect to the axis is greater than 105 degrees and less than 165 degrees.

17. The method of claim 16, wherein the angle at which the second impact surface is disposed with respect to the axis is greater than 15 degrees and less than 75 degrees.

* * * * *